United States Patent [19]

Woloski et al.

[11] Patent Number: 4,497,014

[45] Date of Patent: Jan. 29, 1985

[54] CEILING FIXTURE HAVING SELF-ACTIVATING MOUNTING MEANS

[75] Inventors: Leonard E. Woloski, Jersey City; Walter E. Wyles, Somerset, both of N.J.

[73] Assignee: Lightolier Incorporated, Jersey City, N.J.

[21] Appl. No.: 538,270

[22] Filed: Oct. 3, 1983

Related U.S. Application Data

[63] Continuation-in-part of Ser. No. 426,173, Sep. 28, 1982, Pat. No. 4,424,554.

[51] Int. Cl.[3] ..... F21S 1/02

[52] U.S. Cl. ..... 362/150; 362/217; 362/368; 362/370; 362/404; 362/408

[58] Field of Search ..... 362/150, 217, 223, 368, 362/370, 404, 408

[56] References Cited

U.S. PATENT DOCUMENTS

| | | | |
|---|---|---|---|
| 4,161,019 | 7/1979 | Mulvey | 362/148 X |
| 4,419,717 | 12/1983 | Price et al. | 362/148 X |
| 4,424,554 | 1/1984 | Woloski et al. | 362/404 X |

*Primary Examiner*—Stephen J. Lechert, Jr.
*Attorney, Agent, or Firm*—Arthur B. Colvin

[57] ABSTRACT

A lighting fixture adapted to be mounted between parallel ceiling support grids includes a series of latches at the corners. The latches are retracted responsive to movement of the fixture to a position above the support grids and are released automatically after the fixture is disposed above the grids to define grid engaging supports for the fixture.

8 Claims, 8 Drawing Figures

FIG. 1
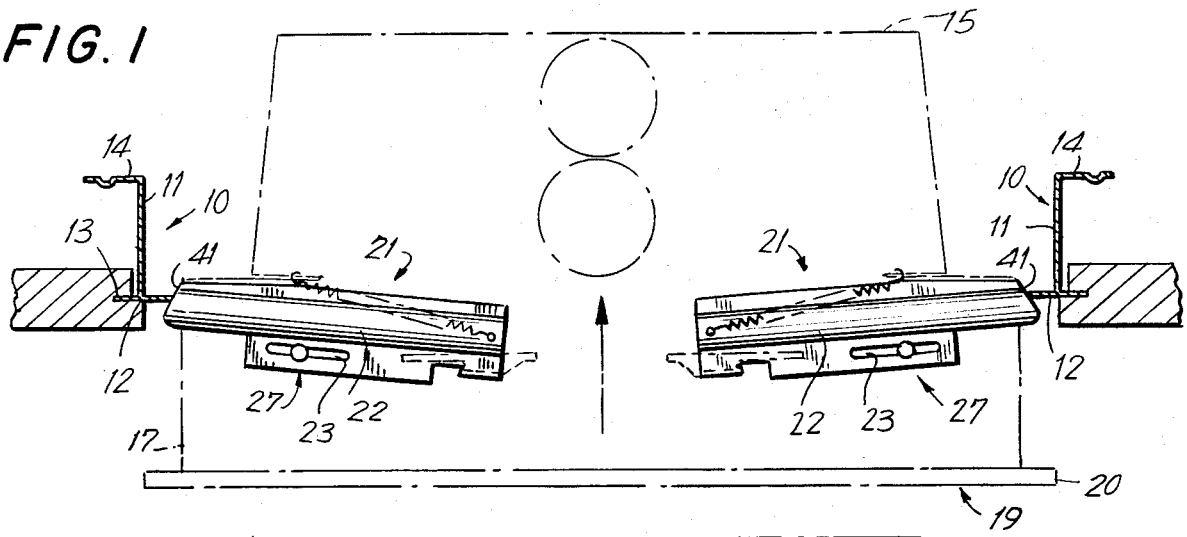
FIG. 2
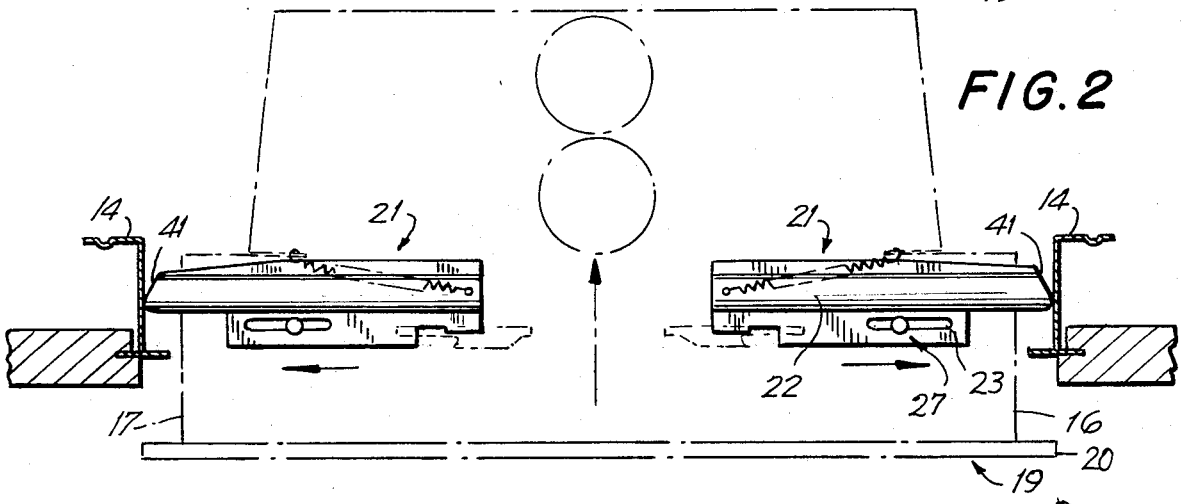
FIG. 6
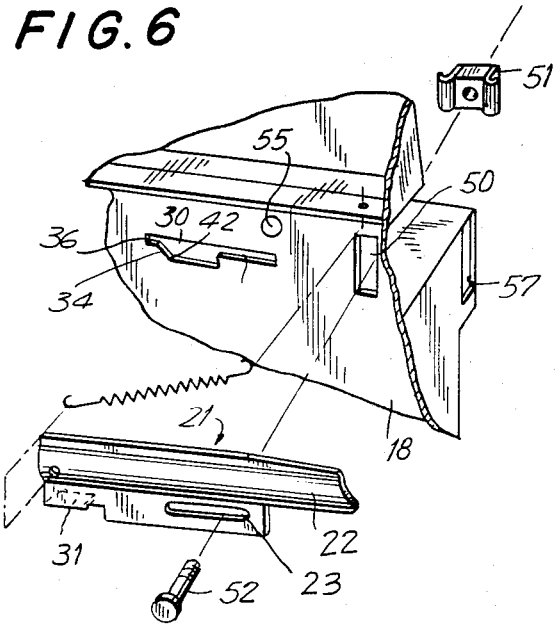
FIG. 8
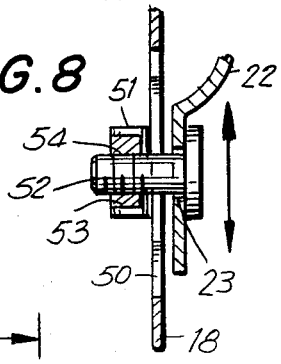
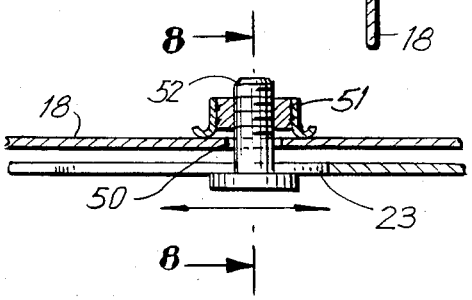
FIG. 7

CEILING FIXTURE HAVING SELF-ACTIVATING MOUNTING MEANS

BACKGROUND OF THE INVENTION

This invention relates to a ceiling mounted fixture, this application constituting a continuation-in-part of our copending application Ser. No. 426,173 filed Sept. 28, 1982, now U.S. Pat. No. 4,424,554 the substance of which is hereby incorporated by reference. More particularly, this invention relates to a lighting fixture adapted to be used with a grid type ceiling tile support assembly.

THE PRIOR ART

It is known to utilized the gridwork employed for supporting ceiling tiles as the means or mechanism for supporting rectangular lighting fixtures disposed between the tiles.

In the typical fixture of the type described the fixture is supported by a series of laterally extending mounting lugs fixed to the corners of the reflector housing. Mounting of the fixture is effected by adjusting the fixture to a height above the height of the grid structure, shifting the lugs laterally and thereafter tightening the lugs. The difficulties inhering in mounting a fixture of the type described are detailed in the above referenced copending application.

Briefly, the device of the above referenced copending application simplifies installation and reduces the waste space encountered in the use of conventionally mounted rectangular fixtures by providing a lighting assembly having a series of spring projected latches at the corners. The installer has merely to elevate the fixture to a height above the ceiling support grids and normally activate detents at the corners, whereupon latches spring outwardly to a position whereat the undersurface of the latches rests against the upper surface of the support grids.

While the device of the aforesaid application constitutes a substantial improvement in the art, installation of such lighting fixture still presented an awkward procedure. Moreover, the device did not provide means for heightwise adjustment of the fixture to accommodate minor irregularities in ceiling configuration or misadjustment in a heightwise direction of the ceiling supporting gridwork.

SUMMARY OF THE INVENTION

The present invention may be summarized as directed to a lighting fixture adapted to be installed in a recessed condition between the grids of a ceiling tile support structure. The device includes a housing having at the corners thereof spring projected latch members which are restrained from shifting outwardly by detent means interposed between the latch members and elements of the housing.

A characterizing feature of the invention resides in the provision of a latching assembly whereby the latch members automatically are retracted responsive to movement of the fixture to a position above the grid structure, and automatically spring outwardly into fixture supporting position responsive to movement of the fixture to its mounted position. More particularly, the latch members are provided with cam means positioned to interact with the grid members upon upward movement of the fixture, which interaction functions to further retract the latch members and also to engage further cam mechanism which release the detent mechanisms retaining the latch members in a partially retracted position so that the latch members are free to spring outwardly after the fixture is lifted to a level above the ceiling grid structure.

A further characterizing feature of the invention resides in the provision of fulcrum means which support the latch members for slideable as well as tilting movements. A degree of heightwise adjustment of the fixture is afforded by adjustably shifting the fulcrum members relative to the housing of the lighting fixture.

It is accordingly an object of the invention to provide an improved recessed lighting fixture adapted to be mounted to the gridwork supporting a ceiling tile installation.

A further object of the invention is the provision of a fixture of the type described wherein the fixture may be fixedly mounted between the grids defining a ceiling tile support assembly by the simple action of lifting the lighting fixture to a height above the support grids.

Still a further object of the invention is the provision of a fixture of the type described wherein a degree of heightwise adjustability is afforded enabling the fixture to be accommodated to ceiling irregularities.

A still further object of the invention is to provide a fixture of the type described in the above referenced copending application, but providing improvements in ease of mounting and in degree of adjustability as contrasted with the fixture of said application.

Still further objects will appear herein or be hereinafter pointed out in connection with the description of the drawings wherein:

FIG. 1 is a vertical sectional view through a ceiling showing the position of the parts of the fixture and support grids as the fixture is shifted to its mounted position.

FIG. 2 is a view similar to FIG. 1 showing the position of the parts at an intermediate condition during the mounting procedure.

FIG. 6 is exploded perspective view of the modified latch assembly in accordance with the invention.

FIG. 7 is a horizontal section in magnified scale of the latch embodiment depicted in FIG. 6.

FIG. 8 is a vertical section taken on the line 8—8 of FIG. 7.

Figure 3:
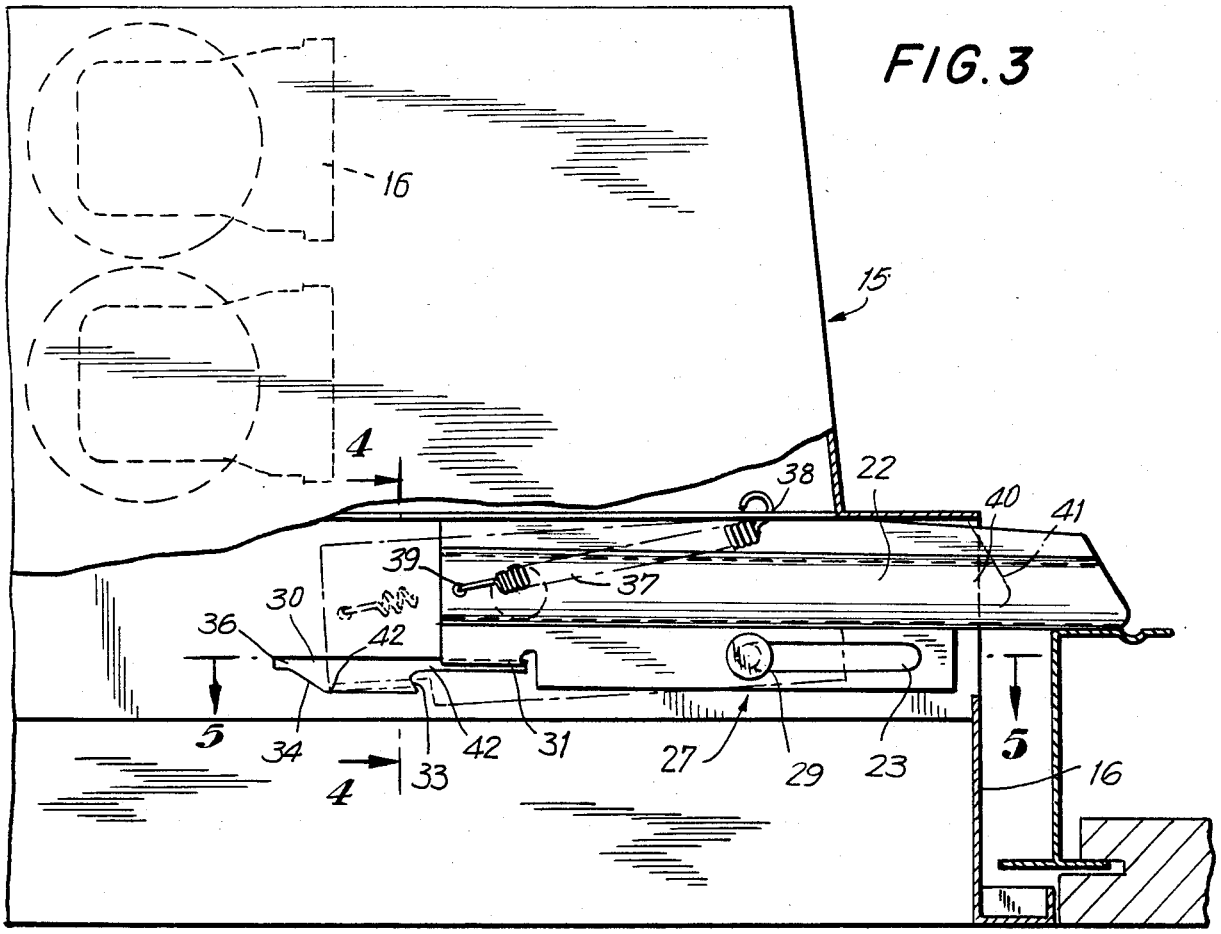
FIG. 3 is a fragmentary vertical sectional view showing in solid lines the position of the parts of the latching assembly when the fixture has reached its mounted position.

Turning now to the drawings, there is shown in FIG. 1 a cross sectional view through a conventional ceiling tile support assembly which includes a plurality of inverted T-bars 10 having depending web portions 11 at the bottom ends of which are disposed tile support branches 12 arrayed in a generally horizontal plane.

As is conventional the ceiling tile members C include horizontally directed mounting slots 13 adjacent their side marginal edges, the tiles being mounted by the insertion of the slots 13 onto the opposite branches 12 of the supports 10.

Support members 10 include hanger ledges 14 extending from the uppermost portion of the webs 11, the hanger portions being suspended from structural components of the building by depending support wires (not shown).

The specific configuration of the support members 10 is not critical to the present invention, it being understood that the fixture of the present invention may be used with a wide variety of tile support assembly grid systems such as Z-bar systems and the like.

As best seen in FIGS. 1, 2 and 3 the lighting fixture of the present invention includes a housing 15 within which is supported any conventional lighting means such as fluorescent lamps 16. The housing 15 is generally rectangular in horizontal section including end walls 16,17 and spaced parallel side walls 18,18 extending between the end walls 16,17. The end walls 16,17 and side walls 18,18 together define at their lower edges a downwardly open mouth portion 19 which optionally but preferably may be covered by a removeable laterally, outwardly extending frame or flange 20. The flange 20 may form an extension of a diffuser support assembly, as is conventional, wherein a translucent or prismatic light transmitting member is mounted to conceal direct visual access to the fluorescent bulbs or like lighting members.

The housing 15 is mounted to the support members 10 by four latch assemblies 21 which are moveably mounted adjacent the inside of the side walls 18 of the housing at the corners. Since the latch assemblies 21 are identical to each other a description of one will suffice.

The latch assemblies include elongate metallic members 22 which are slideable along the inside of walls 18. The members 22 include elongate slot portions 23 extending generally axially of the latch members, the slot 23 in the embodiment of FIGS. 1 through 5 encompassing the body portion 26 of rivet member 27. The rivet members 27 are headed as at 28 and 29 inwardly and outwardly of the housing and thus it will be seen that the latch members 21 are constrained by the headed rivets 27 to slideable movement in a plane paralleling the plane of the side walls 18. The side walls 18 adjacent their corner portions are provided with slots or cut-outs 30 within which are moveably mounted, inwardly directed detent portions 31 projecting from the latch members 22. The detent portions 31 include latching shoulders 32 which face outwardly toward the periphery of the housing. The shoulders 32 are adapted to cooperate with a retainer ledge of sear 33 formed by a downward projection of the slot 30.

The slot 30 includes an upwardly inclined cam shoulder 34 which lies behind the rear shoulder 35 of the tab 31 when the forward shoulder 32 of said tab is engaged against the sear 33. The slot 30 includes a clearance area 36 which permits an inward travel of the latch members 22 from the detented position shown in dot and dash lines in FIG. 3. The latch members 22 are yieldably, outwardly urged by spring members 37 biased between anchor points 38 and 39 on the housing and latch member 22 respectively.

As will be best appreciated from an inspection of FIG. 3, it will be seen that the spring 37 functions to engage the retainer shoulder 32 of tab 31 against the sear 33, whereby the latch member 22 is prevented from springing outwardly under the influence of spring 37. The latch members 22 include a distal or nose portion 40 projecting outwardly beyond the end walls of the housing the uppermost surface 41 of the nose defining a cam configuration.

The device is supplied with the latch members 22 in the partially retracted position illustrated in FIG. 1. In such condition the spacing between the caming portions 41 of the nose 40 is calculated to coordinate with the standardized spacing of the tile support hangers 10. The device is installed by merely passing the housing upwardly between an adjacent pair of hanger members 10 until the cam surfaces 41—41 of the latch members 22 engage against the undersurface 12 of the hanger members 10. Further upward movements of the housing function to deflect the latch members 22 progressively inwardly, i.e. toward each other, so as to permit the nose portions 40 to spring past the support portions 12 of the adjacent hanger members 10.

In the course of such inward movement as best perceived from FIG. 3 the rearmost edge portion 42 of the latch members will eventually engage against the cam portion 34 in slot extension 30. The net result of such engagement will be to tilt the nose portions 40 in a downward direction about the fulcrum defined by the rivet member 26. Such tilting movement lifts the detent 31 to a level above the sear 33, whereby the latch members 22 are free to spring outwardly without interference between the detent and sear.

In FIG. 2 the lighting fixture is illustrated as having been lifted to an intermediate position whereat the nose portions 40 engage against the vertical webs 11 of the grids or hanger members. A comparison of FIGS. 1 and 2 discloses the tilting movement of the latch members 22 resulting from the engagement of latch members against cam surface 34 as described hereinabove.

With continued upward movement of the housing the latch members will pass to a heightwise position above the portions 14 of the grids or hanger members 10. When the housing reaches this upwardmost position, the latch members 22 will spring outwardly to the dashed line position of FIG. 2 from the solid line position depicted in such figure. With the parts thus disposed, the detent 31 will lie in the narrow slot portion 42 whereupon it will be perceived that the latches are supported at two spaced points, i.e. by the engagement of the fulcrum member 27 in slot 23 and the detent 31 in narrow portion 42 of slot 30. It is thus clear that significant movement of the latched members 22 is prevented. The housing may now be released and will be supported in position between the grids 10 in a proper heightwise orientation with respect to the ceiling tiles C surrounding the lighting fixture.

In FIGS. 6 through 8 there is disclosed an embodiment of the invention wherein a degree of heightwise adjustment is permitted. In such figures like parts have been given like reference numerals to the prior described embodiment. In the (FIG. 6) embodiment, a vertically directed slot 50 is formed in side walls 18 of the housing. A lock nut member 51 is disposed adjacent the housing wall 18 and the machine screw 52 extends through slot 23 of the latch member 22 through the vertical slot 50 and into the lock nut assembly 51. The lock nut assembly 51 preferably includes a fiber or polymeric insert 53 having a threaded aperture 54 complemental to the threading of machine screw 52. The insert 53 thus provides frictional retention against unthreading of the machine screw 52.

The device is installed as before, but after installation it will be appreciated that a degree of vertical orientation of each of the corners of the housing may be effected by releasing the machine screw 52 a few turns, setting the housing at a desired heightwise relation by upward or downward movement of the machine screw and retainer nut, and thereafter retightening the machine screw 52.

Figure 4:
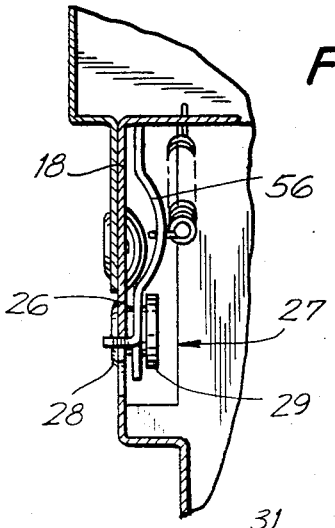
FIG. 4 is a vertical section taken on the line 4—4 of FIG. 3.
Figure 5:
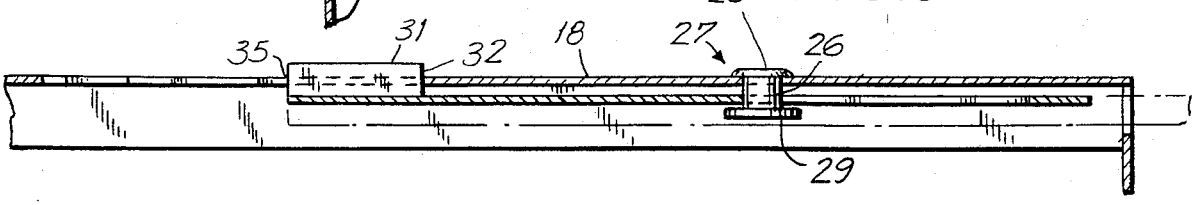
FIG. 5 is a horizontal section taken on the line 5—5 of FIG. 3.

Optionally, but preferably, the latch members 22 are rigidified by having their body portions bent to an arcuate or concave configuration as best seen in FIGS. 4, 6 and 8. Desireably, a dome or protuberance 55 projects inwardly from the side wall portions 18 into the arcuate channel 56 of the latch members 22.

As best seen from FIG. 6 the end walls 16–17 of both described embodiments are provided with slots 57 enabling outward movement of the latch members 22 from a partially retracted position wherein the detent and sear components are engaged, to a fully retracted position resulting from inward caming of the latch members by interaction with the support grids, and finally to a projected position whereat the undersurface of the latch members overlie the support grids to afford mounting support for the fixture.

From the foregoing description it will be appreciated that there is provided in accordance with the present invention a lighting fixture which may be readily mounted between spaced grids of a ceiling support structure with a minimum amount of manipulative movements by the installer. In accordance with the embodiment of the FIGS. 6 through 8 a degree of heightwise adjustment is permitted to allow for irregularities in the installation of the ceiling grid supports and/or the ceiling tiles. As is conventional, the diffuser member carried by the frame assembly 20 may be removed with the frame for relamping, removal of the frame assembly likewise permitting access to the latches from the interior of the housing.

As will be apparent to those skilled in the art numerous variations in details of construction from the specifics of the illustrated embodiments may be made without departing from the spirit of the invention. Accordingly the same is to be broadly construed with the scope of the appended claims.

Having thus described the invention and illustrated its use, what is claimed as new and is desired to be secured by Letters Patent in the United States is:

1. An automatic trip recessed lighting fixture adapted to be mounted between and supported on parallel grids of a ceiling tile support structure, said grids being spaced a predetermined distance apart, comprising a generally rectangular downwardly open light housing having side walls, end walls and a top wall, each of said side walls having moveably mounted thereon a support latch assembly shiftable on a path parallel to said side walls between a partially retracted position whereat the distal ends of said latch members extend a first distance beyond said end walls, a retracted position whereat the distal ends of said latch members extend a lesser distance than said first distance beyond said end walls, and a projected position whereat said distal ends extend a greater distance than said first distance beyond said end walls, the spacing between the distal ends of said latch assemblies on each said wall being greater than said predetermined distance in said partially retracted position, substantially equal to said predetermined distance in said retracted position, and substantially greater than said predetermined distance in said projected position of said latch assemblies, spring means biased between said latch assemblies and housing and urging said latch assemblies toward said projected position, detent means including complemental portions on said latch assemblies and said housing for retaining said latch assemblies in said partially retracted position in the engaged condition of said complemental portions, cam means on said distal ends of said latch assemblies positioned to coact with a spaced pair of said grids for shifting said latch assemblies from the partially retracted to the retracted position of said latch assemblies, responsive to upward movement of said latch assemblies to a position above said grids and for releasing the complemental portions defining said detent means whereby said latch assembly are shifted from said partially retracted to said projected positions responsive to movement of said latch assemblies to a position above said grids.

2. Apparatus in accordance with claim 1 wherein said latch assemblies are tiltably mounted on said side walls, said complemental portions defining said detents being engaged in a first tilted position of said latch assemblies and being tilted out of engagement to a release position thereof responsive to movement of said housing to a position above said grids.

3. Apparatus in accordance with claim 2 and including deflector cam means formed on said side walls for tilting said latch members to release said complemental portions responsive to predetermined retractile movement of said latch assemblies.

4. Apparatus in accordance with claim 2 and including fulcrum means mounted on said side walls of said housing, elongate slot members formed in said latch means, said slot members extending longitudinally of said latch means and encompassing said fulcrum means to define said tiltable mounted connection of said latch means.

5. Apparatus in accordance with claim 4 wherein said fulcrum means are vertically adjustably mounted on said side walls.

6. For use in combination a ceiling grid structure including a pair of parallel support grids spaced a predetermined distance apart, a generally rectangular light housing including a downwardly open lighting chamber, said housing including side walls and end walls, a pair of latch means moveably mounted on each said side wall and projecting beyond said end walls, spring means urging said latch means outwardly to a position whereat the distal ends of the latch means are spaced a distance greater than said predetermined distance, upwardly facing cam means formed on the projecting portions of said latch means, support portions formed on the under surfaces of the projecting portions of said latch means, said grid and cam portions being positioned to coact to shift said latch means toward each other responsive to movement of said housing to a position above said grids, whereby said housing may be mounted to said grid automatically by said upward movement.

7. Apparatus in accordance with claim 6 and including detent means interposed between said latch means and housing for holding said latch means against outward movement, said detent means being disengaged responsive to engagement of said cam portions against said grids.

8. Apparatus in accordance with claim 7 and including deflector cam means on said housing in the path of said latch means for tilting said latch means responsive to predetermined inward movement thereof to thereby disengage said detent means.

* * * * *